US008334816B2

(12) United States Patent
McSpadden

(10) Patent No.: US 8,334,816 B2
(45) Date of Patent: Dec. 18, 2012

(54) RECTENNA COVER FOR A WIRELESS POWER RECEPTOR

(75) Inventor: James McSpadden, Allen, TX (US)

(73) Assignee: Raytheon Company, Waltham, MA (US)

( * ) Notice: Subject to any disclaimer, the term of this patent is extended or adjusted under 35 U.S.C. 154(b) by 810 days.

(21) Appl. No.: 12/512,450

(22) Filed: Jul. 30, 2009

(65) Prior Publication Data

US 2010/0026603 A1 Feb. 4, 2010

Related U.S. Application Data

(60) Provisional application No. 61/085,704, filed on Aug. 1, 2008.

(51) Int. Cl.
*H01Q 1/42* (2006.01)

(52) U.S. Cl. ..... 343/872; 343/705

(58) Field of Classification Search ..... 343/705, 343/708, 872
See application file for complete search history.

(56) References Cited

U.S. PATENT DOCUMENTS

| | | | | |
|---|---|---|---|---|
| 5,276,455 | A | 1/1994 | Fitzsimmons et al. | |
| 5,321,414 | A | 6/1994 | Alden et al. | |
| 5,408,244 | A | 4/1995 | Mackenzie | |
| 5,886,671 | A | 3/1999 | Riemer et al. | |
| 6,307,510 | B1 | 10/2001 | Taylor et al. | |
| 6,919,847 | B2 * | 7/2005 | Caplan et al. | 343/705 |
| 8,130,167 | B2 * | 3/2012 | Glabe et al. | 343/872 |
| 2010/0126567 | A1 * | 5/2010 | Kaufman | 136/252 |

FOREIGN PATENT DOCUMENTS

| | | |
|---|---|---|
| JP | 2004 328808 | 11/2004 |

OTHER PUBLICATIONS

Notification of Transmittal of the International Search Report and the Written Opinion of the International Searching Authority or the Declaration, International Application No. PCT/US2009/052336, 17 pages, dated Nov. 3, 2009.

Schlesak, et al. "A microwave powered high altitude platform", pp. 283-286, dated May 25, 1988.

* cited by examiner

*Primary Examiner* — Tan Ho

(57) ABSTRACT

According to one embodiment, a cover comprising a higher dielectric constant layer disposed outwardly from a lower dielectric constant layer is coupled to a rectenna operable to convert microwave power to electrical power. The cover receives microwave power, provides a substantial impedance match for a plurality of angles of incidence, and directs the microwave power to the rectenna. The impedance match is selected to broaden a receive pattern of the rectenna.

20 Claims, 3 Drawing Sheets

RECTENNA COVER FOR A WIRELESS POWER RECEPTOR

RELATED APPLICATIONS

This application claims priority to U.S. Provisional Patent Application Ser. No. 61/085,704, entitled "WIRELESS ENERGY RECEPTOR," which was filed on Aug. 1, 2008. U.S. Provisional Patent Application Ser. No. 61/085,704 is hereby incorporated by reference.

TECHNICAL FIELD OF THE DISCLOSURE

This disclosure relates generally to wireless power receptors, and more particularly to a rectenna cover for a wireless power receptor.

BACKGROUND OF THE DISCLOSURE

A rectifying antenna (rectenna) is a type of antenna that generates electrical power by converting microwave power received wirelessly from a remote transmission station. Rectennas may have one or more electrically conductive elements designed to receive and rectify microwave power over one or more frequency ranges. Microwave power transmission may provide efficient power transfer due at least in part to its relatively narrow beamwidth and bandwidth.

SUMMARY OF THE DISCLOSURE

According to one embodiment, a cover comprising a higher dielectric constant layer disposed outwardly from a lower dielectric constant layer is coupled to a rectenna operable to convert microwave power to electrical power. The cover receives microwave power, provides a substantial impedance match for a plurality of angles of incidence, and directs the microwave power to the rectenna. The impedance match is selected to broaden a receive pattern of the rectenna.

Certain embodiments of the invention may provide one or more technical advantages. A technical advantage of one embodiment may be that a rectenna cover may increase the efficiency of rectennas configured on moving structures, such as unmanned aerial vehicles. For example, a typical rectenna may be relatively non-directional and may require alignment with a transmitting station to receive power efficiently. Alignment, however, may be relatively difficult to maintain for rectennas configured on moving structures. In some embodiments, the rectenna cover may alleviate alignment requirements of known rectenna designs, thereby improving efficiency.

Certain embodiments of the invention may include none, some, or all of the above technical advantages. One or more other technical advantages may be readily apparent to one skilled in the art from the figures, descriptions, and claims included herein.

BRIEF DESCRIPTION OF THE DRAWINGS

A more complete understanding of embodiments of the disclosure will be apparent from the detailed description taken in conjunction with the accompanying drawings in which.

DETAILED DESCRIPTION OF EXAMPLE EMBODIMENTS

Rectennas may wirelessly convert electromagnetic power to direct current (DC) power. In certain embodiments, a rectenna may receive microwave power in the microwave frequency range transmitted from a remote transmission station and convert the received microwave power to electrical power. Microwave transmitters may be relatively directional and may have a relatively narrow transmit pattern, which may degrade the power transfer efficiency of moving rectennas.

Figure 1:
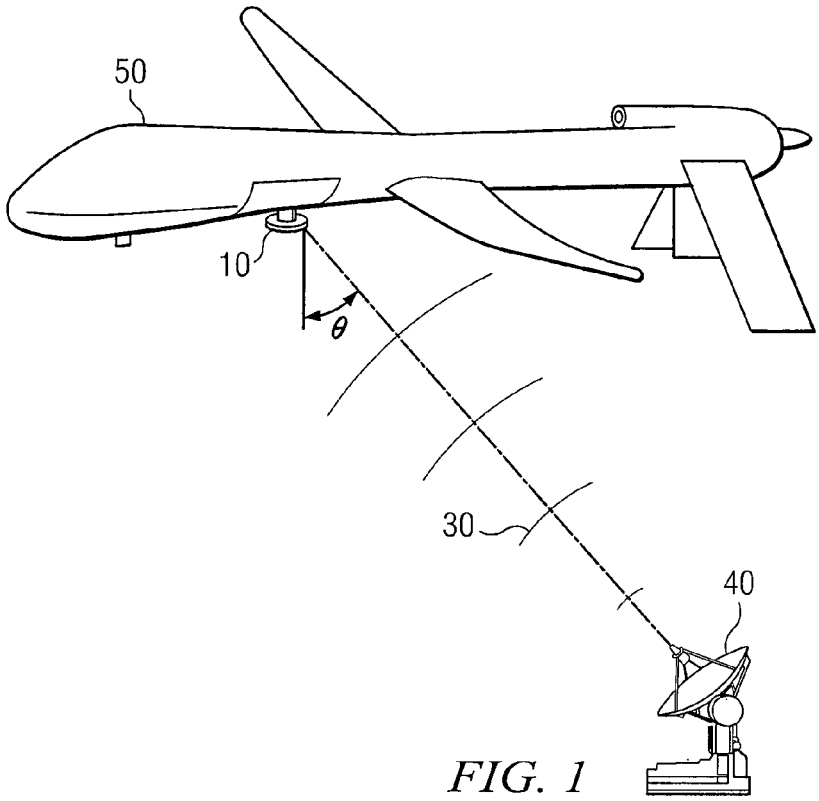
FIG. 1 illustrates an example of a wireless power receptor configured on an unmanned aerial vehicle.

FIG. 1 shows one embodiment of a wireless power receptor 10 for wirelessly receiving microwave power 30 and converting the received microwave power 30 to electrical power. Microwave power 30 may comprise electromagnetic waves and may be transmitted to the wireless power receptor 10 from a remote transmission station 40. In some embodiments, wireless power receptor 10 may be configured on a moving platform. The moving platform may use power for movement. In certain embodiments, the moving platform may be a vehicle powered by electricity or may have one or more control systems powered by electricity, such as an electrically powered unmanned aerial vehicle (UAV) 50. The electrical power generated by wireless power receptor 10 may be used to charge the batteries of UAV 50 while the UAV is in flight, which may allow for increased flight durations.

In some embodiments, wireless power receptor 10 may receive microwave power 30 at an angle of incidence $\theta$ ranging from 0 to 90 degrees. For example, the angle of incidence $\theta$ may be 0 degrees when a rectenna of wireless power receptor 10 is directly aligned with the transmission path of microwave power 30. As the angle of incidence $\theta$ increases, the rectenna and remote transmission station 40 may become increasingly misaligned, and significant degradation of power transfer may occur. If the rectenna is configured on a moving platform, the angle of incidence $\theta$ may increase at certain points along the flight path, and the efficiency at which wireless power receptor 10 receives microwave power 30 may decrease. Accordingly, wireless power receptor 10 may include a wide-angle impedance matching (WAIM) rectenna cover that broadens the receive pattern of the rectenna by providing a good impedance match over many angles of incidence and improving the power transfer efficiency. In one embodiment, the wireless power receptor may be shaped to conform to an outer surface of the moving platform, such as the curve of a wing or underbody of the UAV.

Figure 2:
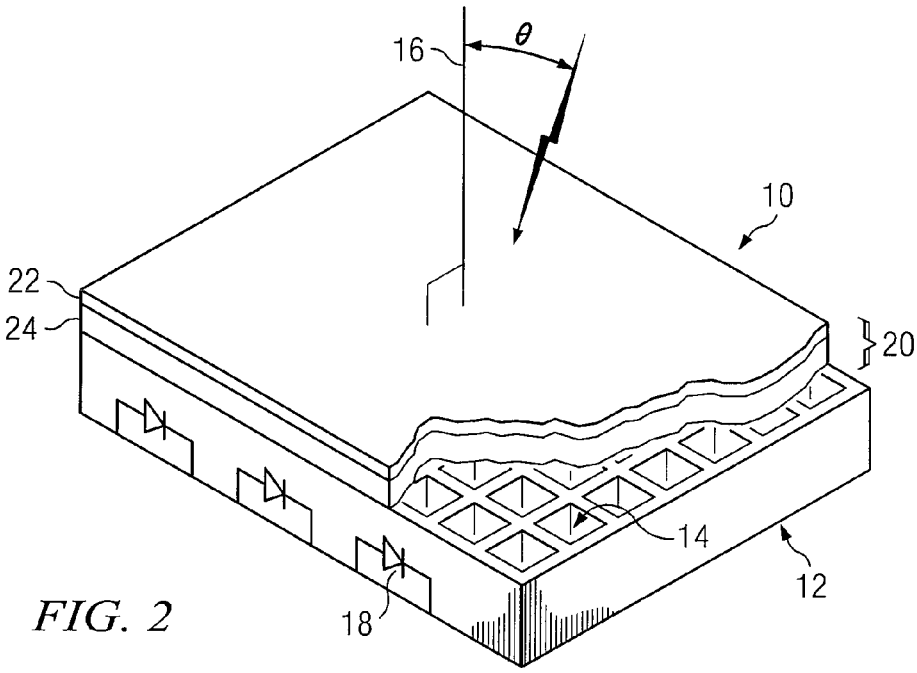
FIG. 2 illustrates an example of a wireless power receptor comprising a rectenna cover.

FIG. 2 shows one embodiment of a wireless power receptor 10 comprising a rectenna 12 and a wide-angle impedance matching rectenna cover 20. In some embodiments, microwave power 30 may pass through rectenna cover 20 prior to being received by rectenna 12.

Rectenna cover 20 may broaden the receive pattern of rectenna 12. The receive pattern may be the range within which rectenna 12 efficiently receives power. The efficiency may be improved by, for example, greater than 20% at an angle of incidence of approximately 60 degrees compared to a rectenna without a rectenna cover 20. Rectenna 12 may include an aperture 14 for receiving microwave power, and may efficiently receive microwave power that arrives aligned with a boresight axis 16 perpendicular to aperture 14. Rectenna cover 20 may broaden the receive pattern of rectenna 12 to efficiently receive microwave power 30 at an angle of incidence θ that is oblique to boresight axis 16.

The rectenna cover 20 may receive electromagnetic waves and direct the electromagnetic waves to the rectenna 12. In some embodiments, the impedance of rectenna cover 20 may be selected to yield a desired impedance for wireless power receptor 10 at wide angles of incidence θ. That is, the impedance of rectenna cover 20 may be selected to compensate for differences between an impedance of the rectenna 12 and a desired impedance. In some embodiments, the desired impedance may be the impedance of free space (377 ohms) and the impedance of wireless power receptor 10 may range from approximately 280 to 500 ohms to substantially match the free space impedance.

Rectenna 12 may include any suitable type of antenna that converts received microwave power 30 to electrical power.

Rectenna 12 may be configured to receive microwave power 30 at any suitable frequency. In one embodiment, rectenna 12 may be configured to receive a frequency having a relatively directional transmission path, such as a frequency ranging from approximately 2.45 Giga-Hertz to 95 Giga-Hertz. A frequency having relatively directional transmissions may provide relatively efficient power transfer.

In some embodiments, rectenna 12 may include an array of conductive elements for receiving microwave radiation, such as linearly polarized elements, dual polarized elements, and/or circular polarized elements. Rectenna 12 may include rectifying circuitry 18 for converting microwave radiation to direct current (DC) electrical power. In the particular embodiment shown, rectifying circuitry 18 includes a number of diodes coupled to elements of rectenna 12. As an example, one diode may be coupled to each element of rectenna 12. Any type of rectifying circuitry, however, may be used.

In the particular embodiment shown, rectenna cover 20 includes a higher dielectric constant (HDC) layer 22 and a lower dielectric constant (LDC) layer 24. In other embodiments, rectenna cover 20 may have any number and configuration of HDC layers 22 and LDC layers 24. For example, rectenna cover 20 may have two or more HDC layers 22 alternately configured with two or more LDC layers 24. In some embodiments, the thicknesses of the layers may be a fraction of the wavelength of the received electromagnetic waves, and layers with lower dielectric constants may be thicker than layers with higher dielectric constants. Examples of factors that may affect the number of layers may include the maximum angle of incidence and the frequency of operation.

The HDC layers 22 may be made of any material having a higher dielectric constant. In some embodiments, the higher dielectric constant may range from approximately 2 to 10. As an example, HDC layer 22 may comprise materials available from Rogers Corporation located in Rogers, Connecticut or Arlon Corporation located in Santa Ana, Calif. The LDC layers 24 may be made of any material having a lower dielectric constant, such as foam. In some embodiments, the lower dielectric constant may range from approximately 1 to 1.5. As an example, LDC layer 24 may comprise materials such as ROHACELL 31, 51, or 71, available from Rohm Company, located in Darmstadt, Germany. The impedance received at rectenna 12 at various angles of incidence θ may be adjusted by modifying the materials and the thicknesses of the HDC layers 22 and the LDC layers 24.

In some embodiments, rectenna cover 20 may include a water barrier (not shown). The water barrier may be disposed on an outer surface of the HDC layer 22. The water barrier may protect the layers of the cover from damage due to moisture, such as humidity, or other contaminants, such as airborne debris. In some embodiments, the water barrier may be a thin, flexible material, such as ACLAR, available from Honeywell Corporation located in Morristown, N.J.

Figure 3:
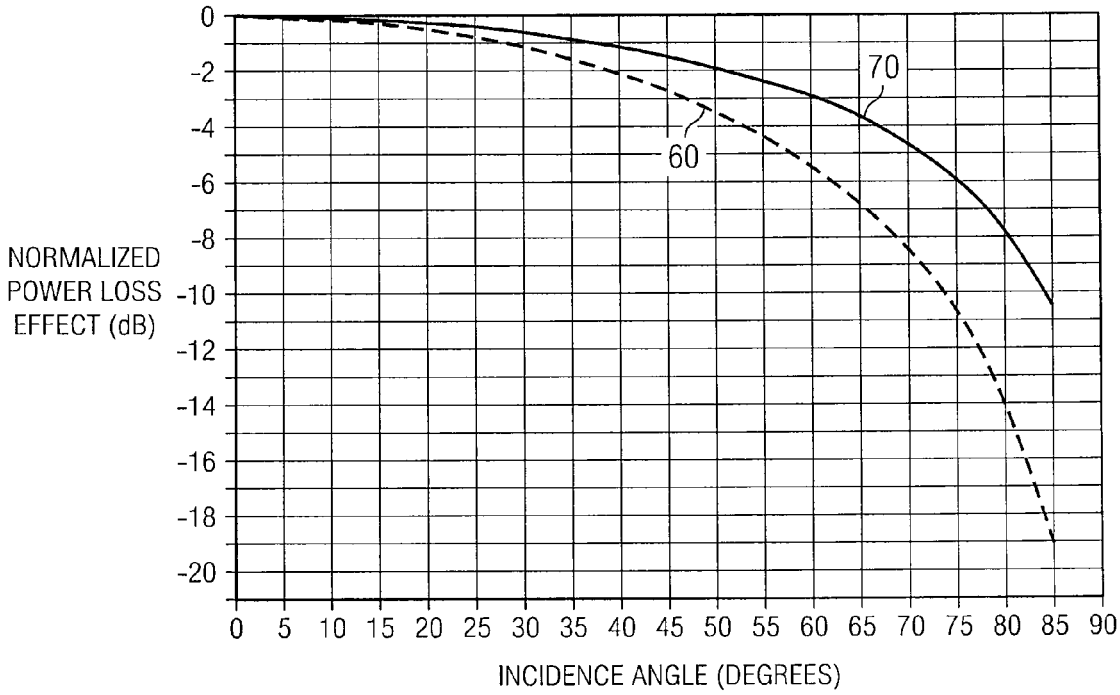
FIG. 3 illustrates examples of rectenna receive patterns with and without a rectenna cover.

FIG. 3 illustrates examples of rectenna receive patterns with and without a rectenna cover. The graph estimates the power loss effect (in normalized decibels) that may be observed at a rectenna for varying angles of incidence θ. As the angle of incidence θ increases, the efficiency at which the microwave power is received may generally decrease. The decrease in efficiency may be referred to as receive pattern roll-off effect. Plot 60 shows the receive pattern of the rectenna without a rectenna cover. Plot 60 measures a 2.45 GHz signal received by a linearly polarized array of horizontal dipole antennas, each antenna terminated in a rectifying diode. Plot 70 shows the receive pattern of the rectenna with a rectenna cover. Plot 70 is theorized with a cos (θ) roll-off (upper limit).

According to the graph, the attenuation at the relatively wider angles of incidence θ is reduced when the rectenna cover is used. For example, at 80 degrees the normalized power loss is approximately −14 dB without the rectenna cover, while the normalized power loss is −7.8 dB with the rectenna cover. Thus, the rectenna cover may significantly reduce the power loss that may occur at relatively wide angles of incidence θ.

Figure 4:
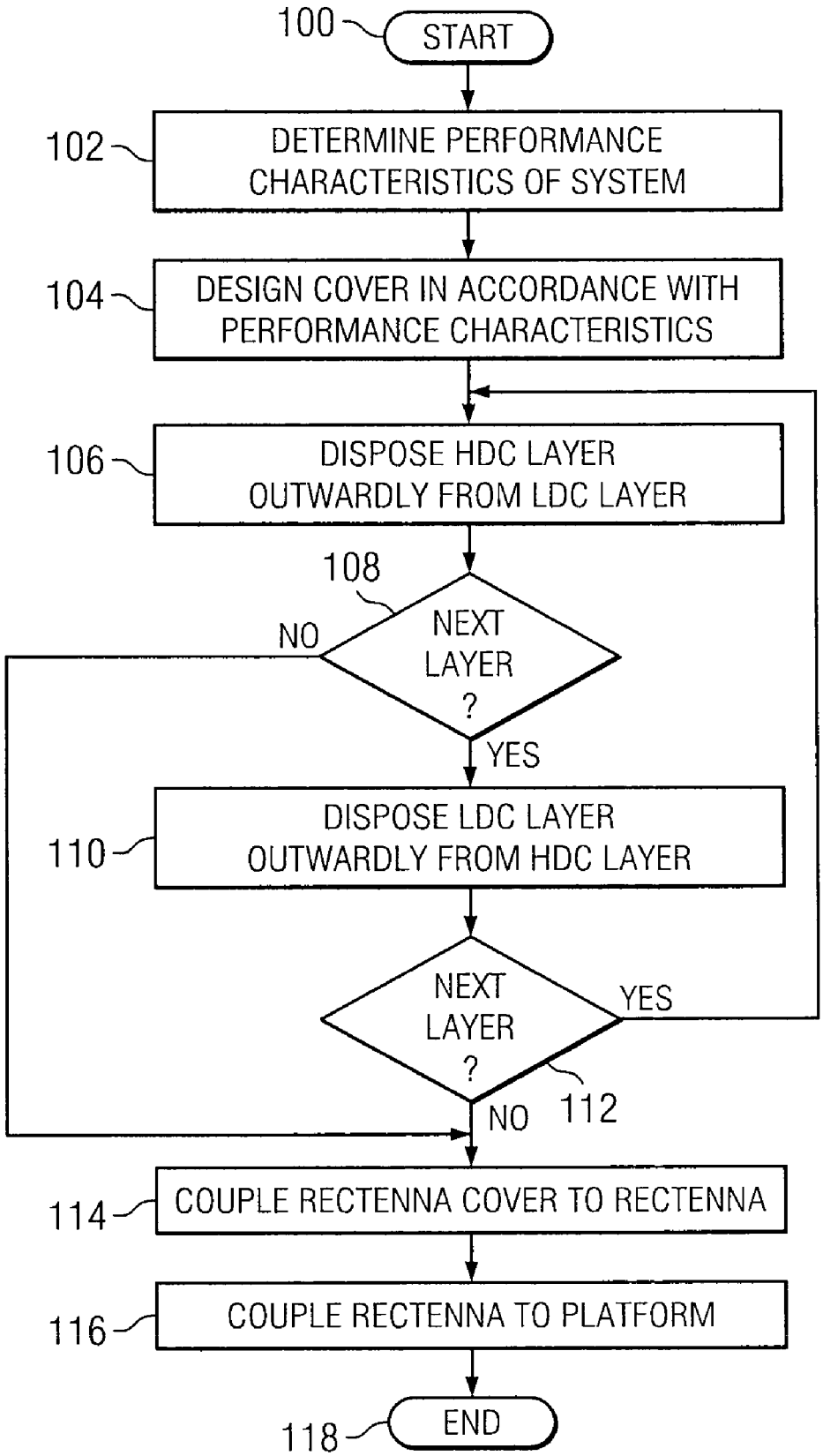
FIG. 4 illustrates an example of a method for using the wireless power receptor on a moving platform.

FIG. 4 illustrates an example of a method for making and using a wireless power receptor, such as the wireless power receptor of FIG. 1, on a moving platform. In step 100, the method is initiated.

In step 102, the performance characteristics of the system may be determined. For example, a desired receive pattern may be determined based upon anticipated angles of incidence of the received microwave power, anticipated frequency ranges of the received microwave power, and/or the desired efficiency. In some embodiments, the anticipated angles of incidence θ may be determined from the flight characteristics of a moving platform of the wireless power receptor. As an example, the moving platform may enter a circular holding pattern while the wireless power receptor receives power from a remote transmission station 40, and the average angle of incidence θ may be approximately 50 degrees or less. In some embodiments, the anticipated angle of incidence θ may be determined from the shape of the wireless power receptor. For example, the anticipated angle of incidence θ may increase if the wireless power receptor is shaped to conform to a curved surface of the moving platform.

In step 104, the rectenna cover may be designed in accordance with the performance characteristics of step 102. In one embodiment, the thickness and constituent materials of the layers of the rectenna cover may be selected to yield the desired receive pattern. As an example, the HDC layer may range from approximately 0.002 to 0.150 inches thick, and the LDC layer may range from approximately 0.05 to 1 inches thick. The thickness of the LDC layer may be selected to hold the HDC layer at a particular distance from an aperture of the rectenna and/or to yield desired impedance characteristics within the LDC layer itself. In general, the rectenna cover may act as a shunt capacitive susceptance in free space and the required thickness of the HDC layer may decrease with increasing permittivity. With respect to the broadside, the susceptance variation may change with angle of incidence according to the following equations, where $\epsilon_r$ is the dielectric constant of the HDC layer:

$$H\text{-Plane Direction: } \frac{B(\Theta)}{B(0^\circ)} = \frac{1}{\cos(\Theta)}$$

$$E\text{-Plane Direction: } \frac{B(\Theta)}{B(0^\circ)} = \cos(\Theta) - \frac{\sin^2(\Theta)}{\epsilon_r \cos(\Theta)}$$

In some embodiments, the design may be affected by certain physical characteristics of the rectenna and/or the rectenna cover. For example, the design may compensate for insertion loss level and/or cross-polarization effects. As another example, the design may compensate for the increase in the angle of incidence θat which microwave power is received by a curved surface.

The rectenna cover design of step 104 may be constructed in steps 106 through 112. In step 106, an HDC layer may be disposed outwardly from an LDC layer. A determination whether to add a next layer is made at step 108. For example, the rectenna cover may be compared to the design of step 104. The method proceeds to step 110 if a next layer is to be added, otherwise the method skips to step 114.

In step 110, an LDC layer is disposed outwardly from an HDC layer. A determination whether to add a next layer is made at step 112. The method returns to step 106 if a next layer is to be added, otherwise the method continues to step 114.

The rectenna cover may be coupled to the rectenna at step 114. In some embodiments, the rectenna cover may be coupled to the rectenna with an adhesive, such as epoxy glue, or any suitable means. The rectenna cover may be disposed adjacent to an aperture of the rectenna. In some embodiments, the rectenna cover may be a single piece such that each layer is sized to extend across all of the apertures of the rectenna.

The rectenna may be coupled to a platform at step 116. In some embodiments, the rectenna may be coupled to a moving platform. At step 118 the method ends.

Modifications, additions, or omissions may be made to the previously described method without departing from the scope of the disclosure. The method may include more, fewer, or other steps. For example, the rectenna cover may have multiple HDC layers that are alternately separated from each other by multiple LDC layers to modify the receive pattern or other operating characteristics of the wireless power receptor.

Although this disclosure has been described in terms of certain embodiments, alterations and permutations of the embodiments will be apparent to those skilled in the art. Accordingly, the above description of the embodiments does not constrain this disclosure. Other changes, substitutions, and alterations are possible without departing from the spirit and scope of this disclosure, as defined by the following claims.

What is claimed is:

1. An apparatus comprising:

a rectenna operable to convert microwave power to electrical power; and a cover coupled to the rectenna and comprising a plurality of layers, the plurality of layers comprising a higher dielectric constant layer disposed outwardly from a lower dielectric constant layer, the cover operable to:

receive microwave power at a plurality of angles of incidence;

provide a substantial impedance match at the plurality of angles of incidence to broaden a receive pattern of the rectenna; and direct the microwave power to the rectenna.

2. The apparatus of claim 1, the cover selected to substantially match an impedance of the rectenna to a desired impedance, the impedance of the rectenna determined according to the angles of incidence.

3. The apparatus of claim 1, the cover selected to substantially match an impedance of the rectenna to an impedance of free space.

4. The apparatus of claim 1:

the higher dielectric constant layer having a first dielectric constant in the range of approximately 2 to 10; and the lower dielectric constant layer having a second dielectric constant in the range of approximately 1 to 1.5.

5. The apparatus of claim 1:

the higher dielectric constant layer having a first thickness in the range of approximately 0.002 to 0.150 inches thick; and the lower dielectric constant layer having a second thickness in the range of approximately 0.05 to 1 inches thick.

6. The apparatus of claim 1, the cover further comprising a water barrier, the water barrier outwardly disposed from the plurality of layers and configured to prevent moisture from entering the layers of the cover.

7. The apparatus of claim 1:

the rectenna having an aperture through which the microwave power is received; and the cover disposed adjacent to the aperture of the rectenna.

8. The apparatus of claim 1, the rectenna coupled to a moving platform.

9. The apparatus of claim 1, the cover shaped to substantially conform to a surface of a platform.

10. The apparatus of claim 1, the rectenna comprising an array of antenna elements coupled to a rectifying circuit, the rectifying circuit operable to convert microwave power from the array of elements to direct current (DC) electrical power.

11. The apparatus of claim 1, the rectenna comprising an array of linearly polarized horizontal dipole antennas coupled to a rectifying circuit.

12. A method comprising:

repeating the following for a predetermined number of layers to yield a rectenna cover:

dispose a first higher dielectric constant layer outwardly from a first lower dielectric constant layer; and dispose a second lower dielectric constant layer outwardly from the first higher dielectric constant layer if a current number of layers does not equal the predetermined number of layers; and coupling the rectenna cover to a rectenna configured to convert microwave power to electrical power.

13. The method of claim 12, further comprising:

determining the predetermined number of layers according to a performance characteristic.

14. The method of claim 12, further comprising:

selecting a desired receive pattern for the rectenna, the desired receive pattern associated with an angle of incidence, a frequency, and an efficiency; and determining the predetermined number of layers according to the desired receive pattern for the rectenna.

15. The method of claim 12, further comprising:

coupling the rectenna to a platform.

16. A method comprising:

receiving microwave power at a cover of a rectenna, the cover comprising a plurality of layers, the plurality of layers comprising a higher dielectric constant layer disposed outwardly from a lower dielectric constant layer, the rectenna operable to convert microwave power to electrical power, the microwave power comprising an electromagnetic wave;

introducing a substantial impedance match to the electromagnetic wave, the impedance match selected to broaden a receive pattern of the rectenna; and directing the electromagnetic wave to the rectenna.

17. The method of claim 16, the cover selected to substantially match an impedance of the rectenna to a desired impedance, the impedance of the rectenna determined according to an angle of incidence at which the microwave power is received.

18. The method of claim 16, the cover selected to substantially match an impedance of the rectenna to an impedance of free space, the impedance of the rectenna and the impedance of free space substantially matched for a plurality of angles of incidence.

19. The method of claim 16:

the higher dielectric constant layer having a first dielectric constant in the range of approximately 2 to 10; and the lower dielectric constant layer having a second dielectric constant in the range of approximately 1 to 1.5.

20. The method of claim 16:

the higher dielectric constant layer having a first thickness in the range of approximately 0.002 to 0.150 inches thick; and the lower dielectric constant layer having a second thickness in the range of approximately 0.05 to 1 inches thick.

* * * * *